US008366875B2

(12) United States Patent
Jonsson

(10) Patent No.: US 8,366,875 B2
(45) Date of Patent: Feb. 5, 2013

(54) METHOD AND ARRANGEMENT FOR WASH AFTER COMPLETED DIGESTION IN A CONTINUOUS DIGESTER FOR THE PRODUCTION OF CELLULOSE PULP

(75) Inventor: Allan Jonsson, Kil (SE)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 13/258,122

(22) PCT Filed: Mar. 19, 2010

(86) PCT No.: PCT/SE2010/050308

§ 371 (c)(1), (2), (4) Date: Nov. 3, 2011

(87) PCT Pub. No.: WO2010/110724

PCT Pub. Date: Sep. 30, 2010

(65) Prior Publication Data

US 2012/0061042 A1 Mar. 15, 2012

(30) Foreign Application Priority Data

Mar. 26, 2009 (SE) ..... 0950193

(51) Int. Cl.
*D21C 7/00* (2006.01)
*D21C 9/02* (2006.01)

(52) U.S. Cl. ..... 162/60; 162/52; 162/237; 162/246

(58) Field of Classification Search ..... 162/60
See application file for complete search history.

(56) References Cited

U.S. PATENT DOCUMENTS

2007/0056707 A1* 3/2007 Snekkenes et al. ..... 162/246
2008/0202717 A1* 8/2008 Saetherasen et al. ..... 162/237

* cited by examiner

*Primary Examiner* — Matthew Daniels
*Assistant Examiner* — Eric Yaary
(74) *Attorney, Agent, or Firm* — Rolf Fasth; Fasth Law Offices

(57) ABSTRACT

Digested softened non-defibrated chips are fed out from a bottom of a digester. The chips are fed out under an influence of a bottom scraper at the bottom of the digester and through an outlet tap at the bottom of the digester and onwards to an outlet line connected to the outlet tap. This takes place before the softened chips pass through a blow-valve arranged in the outlet line, across which blow-valve a pressure drop of at least 0.5 bar and at most 3-5 bar has been established. The chips are exposed to a displacement wash after the chips have passed the outlet tap. The displacement wash has been established in the flow of chips through the outlet line before the chips are defibrated by the pressure drop across the blow-valve.

10 Claims, 6 Drawing Sheets

METHOD AND ARRANGEMENT FOR WASH AFTER COMPLETED DIGESTION IN A CONTINUOUS DIGESTER FOR THE PRODUCTION OF CELLULOSE PULP

This application is a U.S. national phase application based on International Application No. PCT/SE2010/050308, filed 19 Mar. 2010, that claims priority from Swedish patent application no. 0950193-3, filed 26 Mar. 2009.

TECHNICAL AREA

The invention concerns a method and an arrangement for the improvement of a wash after completed digestion in a continuous digester for the production of cellulose pulp. Digested softened chips that have not yet undergone defibration are fed out from the bottom surface of the digester after having passed a final strainer section in the bottom of the digester. The non-defibrated chips are fed out under the influence of a bottom scraper arranged at the bottom of the digester and subsequently through a bucket shaped outlet tap at the bottom of the digester, and onwards to an outlet line connected to the outlet tap. This takes place before the softened chips pass through a blow-valve arranged in the outlet line, across which blow-valve a fall in pressure of at least 0.5 bar and at most 3-5 bar has been established.

BACKGROUND AND SUMMARY OF THE INVENTION

Production has been increased above the original design capacity, principally in older continuous digesters, so much that the conventional digester wash at the bottom of the digester has essentially been eliminated. It is often the case in these overloaded digesters that the dilution factor at the bottom of digester is 0, and in certain extreme cases it may be negative. The dilution factor is the factor that specifies the quantity of washing or dilution liquid that is added at the bottom of the digester relative to the current quantity of cooking fluid in the digester. For a dilution factor of 2.0, as is often desired, 2.0 cubic meters of washing or dilution liquid is added at the bottom of the digester per tonne of pulp (2.0 $m^3$/ADT).

Also new digester plants are designed such that the greater part of the digester is used as cooking zone, such that a longer retention time in the cooking process is obtained, which allows reduction of the required cooking temperature to achieve the H factor necessary for delignification. A longer retention time and lower cooking temperature are beneficial for the strength and yield of pulp, since the cellulose is broken down to a lesser degree, and they also give better control of the cooking process.

Large digesters with capacities of over 4000 tonnes of pulp per day have extremely large diameters, greater than 12 meters, at the bottom of the digester, and this means that it becomes extremely difficult to establish a good displacement of the free fluid from between the softened chips by the addition and withdrawal of washing or dilution liquid through the wall of the digester and arrangements having central pipes.

The conventional technology for adding washing or dilution liquid through vertical and horizontal nozzles in the wall at the bottom surface of the digester often leads to the formation of flows or a film of liquid along the inner wall of the digester shell down towards the outlet. These flows of low temperature with washing or dilution liquid that has a relatively lower temperature can often be detected on the walls of transfer lines to subsequent storage towers or washing equipment, and in certain cases these cold flows are held intact until the inlet of the storage tower or washing equipment.

A known wash is shown in FIG. 1D at the bottom of the digester where washing liquid is added through a central pipe, arranged directly above the bottom scraper, and where expelled cooking fluid is withdrawn from the surrounding wall of the digester wall. The technology corresponds to that revealed in, for example, U.S. Pat. No. 3,475,271. A variant with several displacement stages is revealed in U.S. Pat. No. 4,213,822. One disadvantage here is that a large part of the bottom section of the digester is used for digester washing.

FIG. 1E shows known dilution technology at the bottom of the digester in which dilution liquid is added at the bottom of the digester, typically through nozzles from a source $N_H/N_V$, and where the pulp is dewatered in a subsequent dewatering arrangement 8 in the outlet line 12. The technology corresponds to that revealed in, for example, SE204236. One disadvantage here is that the dilution gives a limited wash, since the filtrate obtained from the dewaterer is recirculated as dilution liquid.

U.S. Pat. No. 3,807,202 reveals a variant of the wash of defibrated pulp at the bottom of towers. A stationary internal distribution space is arranged in this case in the outlet tap, with a surrounding stationary strainer. Washing liquid is added through the central distribution space and expelled liquid is withdrawn through the surrounding strainer. This solution concerns the washing of defibrated pulp, and does not concern the displacement of liquid from softened chips. One disadvantage here is that the strainer and the distributor space are stationary, and where the defibrated pulp must pass through a narrow gap between them. It is easy for the strainer to become clogged by fibre material and the washing process loses its effect.

A further displacement wash of defibrated pulp is revealed in U.S. Pat. No. 6,272,710 and U.S. Pat. No. 6,553,593, where the pulp is divided into thin streams through a rectangular space under atmospheric conditions. This solution is not suitable for a displacement wash of softened chips at full cooking pressure.

The pressure drop that is generated across the blow-valve gives a defibrating effect for the cooked softened chips such that the fibres are released to a greater degree and the pulp can be better washed in a subsequent washing process, preferably a pressure diffuser arranged directly after the digester. It is desired to implement an displacement wash at the relevant process position before the blow-valve between the softened but as yet not defibrated fragments of chip such that the free liquid between the fragments of chip can be exchanged from a free liquid, typically consumed cooking fluid or black liquor, with a high content of dissolved organic material, principally but not exclusively lignin, to a cleaner liquid with a lower content of dissolved organic material.

After defibration in the exchanged cleaner liquid, organic material that was bound in the softened chips can more easily dissolve and the total washing efficiency from the subsequent wash can be considerably improved.

A first purpose of the invention is to achieve an improved displacement wash of the digested and softened chips before defibration of the chips takes place across the blow-valve.

A second purpose is to be able to install this displacement wash in already existing parts of the equipment at the digester plant, such that no further equipment or components are required. The displacement washer can, when installed in new digester plants, be achieved at very low additional cost since it is only necessary to exchange one pulp line for a displacement washer.

A third purpose is to be able to offer, by the rebuilding of existing equipment, an increase in the dilution factor in overloaded digesters, where the production has been increased from the original design capacity so much that the dilution factor has been severely reduced, and in certain cases even eliminated.

The method according to the invention relates to improvement of a wash after completed digestion in a continuous digester for the production of cellulose pulp. Softened chips are fed in the method out from the bottom surface of the digester after having passed a final strainer section in the bottom of the digester. The softened chips are fed out under the influence of a bottom scraper arranged at the bottom of the digester and through a bucket shaped outlet tap at the bottom of the digester and further to an outlet line connected to the outlet tap. Finally, the softened chips pass through a blow-valve arranged in the outlet line, across which blow-valve a pressure drop of at least 0.5 bar and at most 3-5 bar has been established. What is characteristic for the method according to the invention is that the softened chips are exposed to a displacement wash after they have passed the outlet tap, and which displacement wash has been established in the flow of digested softened chips through the outlet line before the softened chips are defibrated by the pressure drop across the blow-valve.

The displacement wash is preferably established between two opposing walls of the outlet line, where one wall has nozzles for the addition of washing fluid and the second opposing wall has strainer surfaces for the withdrawal of liquid.

The displacement wash in the outlet line through the addition and withdrawal in the opposing walls preferably exchanges between 0.1 and 2 cubic meters of liquid per tonne of pulp (ADT) for each 2 meters of outlet line.

In order to minimise the risk of clogging of the section of wall that has strainer surfaces for the withdrawal of liquid, it is appropriate that the displacement wash is established, in at least one module through the addition and withdrawal across the opposing walls, such that this displacement wash changes its direction of displacement after a predetermined time, such that first wall section add washing fluid during a first period of time and then in a subsequent second period of time withdraw liquid, with the inverse functionality taking place in the second wall section. This alternation of the direction of displacement may also take place in a manner based on feedback, through detection of the pressure drop across the bed of chips.

The arrangement is intended for the improvement of a wash after a completed digestion process in a continuous digester for the production of cellulose pulp, in which digested softened chips are fed out from the bottom surface of the digester after having passed a final strainer section in the bottom of the digester and subsequently fed out under the influence of a bottom scraper arranged in the bottom of the digester and thereafter through a bucket shaped outlet tap at the bottom of the digester and onwards to an outlet line (12) connected to the outlet tap, before the softened chips pass through a blow-valve (4) arranged in the outlet line, across which blow-valve a pressure drop of at least 0.5 bar and at most 3 bar has been established. The chips at this position before the blow-valve have been softened and maintain their structure essentially as a bundle of softened fibres. The only noticeable mechanical influence to which the softened chips are exposed is that of the bottom scraper. The arrangement at this position is characterised in that it is constituted by a module of the outlet line before the blow-valve is provided with at least one first axially running section of wall with nozzles for the addition of washing fluid and at least one second section of wall with strainer surfaces for the withdrawal of expelled cooking fluid, where these sections of wall are located at diametrically opposite sides of each other in the inner surface of the outlet line.

It is appropriate that the module in the outlet line has a length of between 2 and 6 meters. Since full cooking pressure has been established in the pulp at this position, also the module must be designed as a pressure vessel, and it is for this reason appropriate that the module be constituted by a tubular pressure vessel, in which pressure vessel the wall sections for the addition and withdrawal of washing fluid are arranged as exchangeable plates.

In order to achieve better displacement washing through thin flows of the softened chips, the module of the outlet line before the blow-valve can be provided with at least one third section of wall that runs in an axial direction and that has nozzles for the addition of washing fluid, and at least one fourth section of wall that runs axially and that has strainer surfaces for the withdrawal of expelled cooking fluid, where these sections of wall are arranged such that sections of wall with nozzles and a sections of wall with strainer surfaces are located arranged facing each other in the inner surface of the outlet line.

By designing the arrangement as a module, increased displacement washing can be easily installed by arranging at least two modules of the outlet line in series. In the case of this installation, at least one module of the outlet line can be arranged in a horizontally running part of the outlet line and at least one module of the outlet line can be arranged in a vertically running part of the outlet line.

DETAILED DESCRIPTION

The concept of "nozzle" will be used in the following detailed description, and this concept is here used to denote either one or several individual nozzles, or distribution plates with holes that add fluid.

Figure 1A:
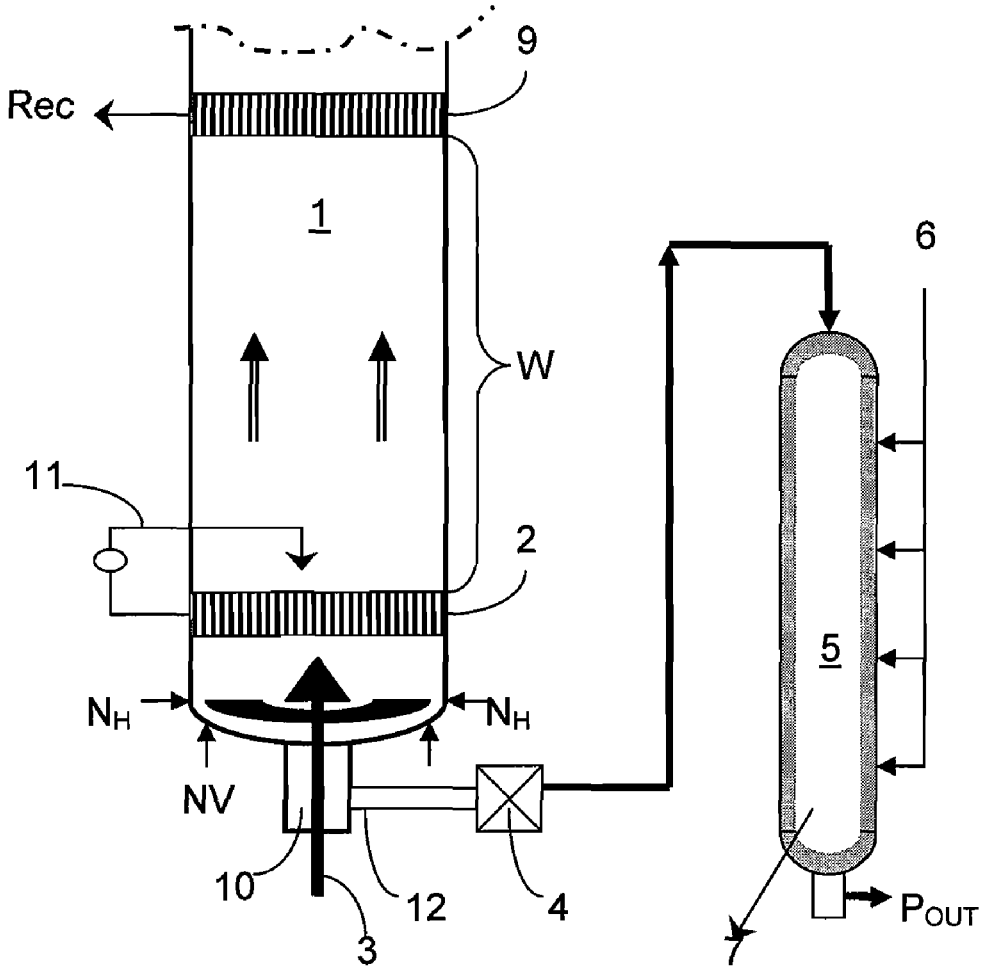
Fig. 1A Prior Art
FIGS. 1A-1E show various known designs of washing zones in the bottom of a continuous digester.
Figure 1B:
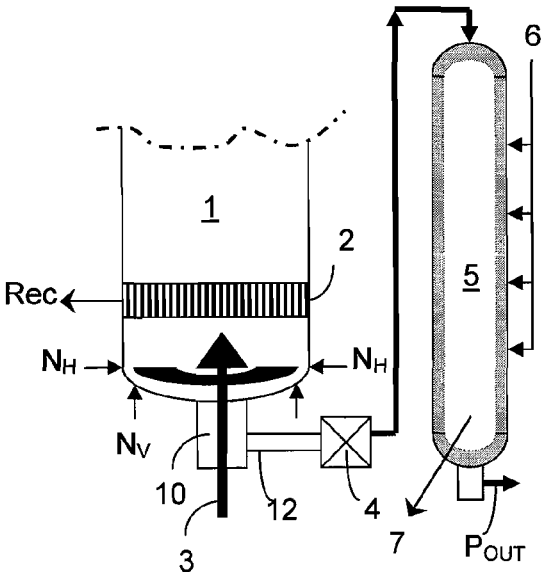
Fig. 1B Prior Art
Figure 1C:
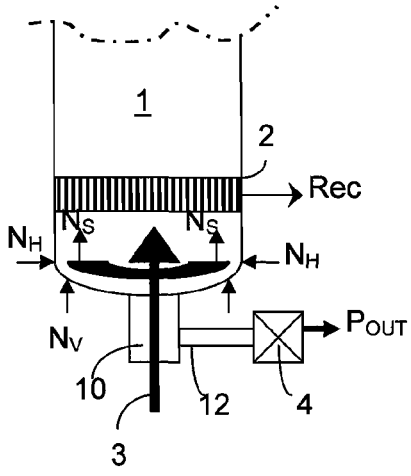
Fig. 1C Prior Art
Figure 1D:
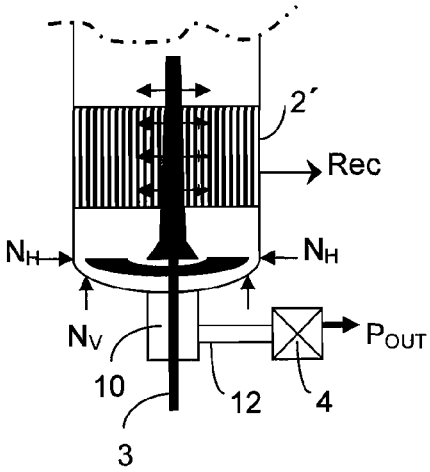
Fig. 1D Prior Art
Figure 1E:
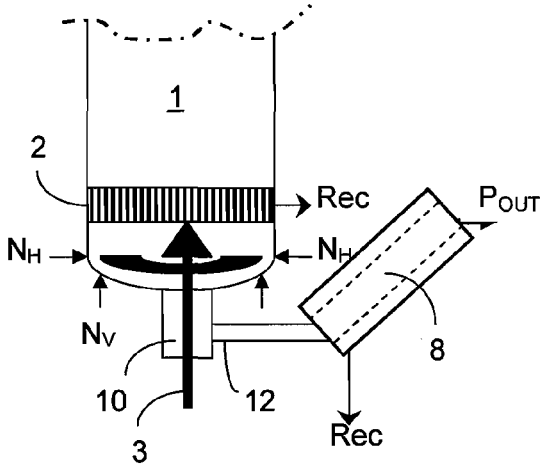
Fig. 1E Prior Art
Figure 2:
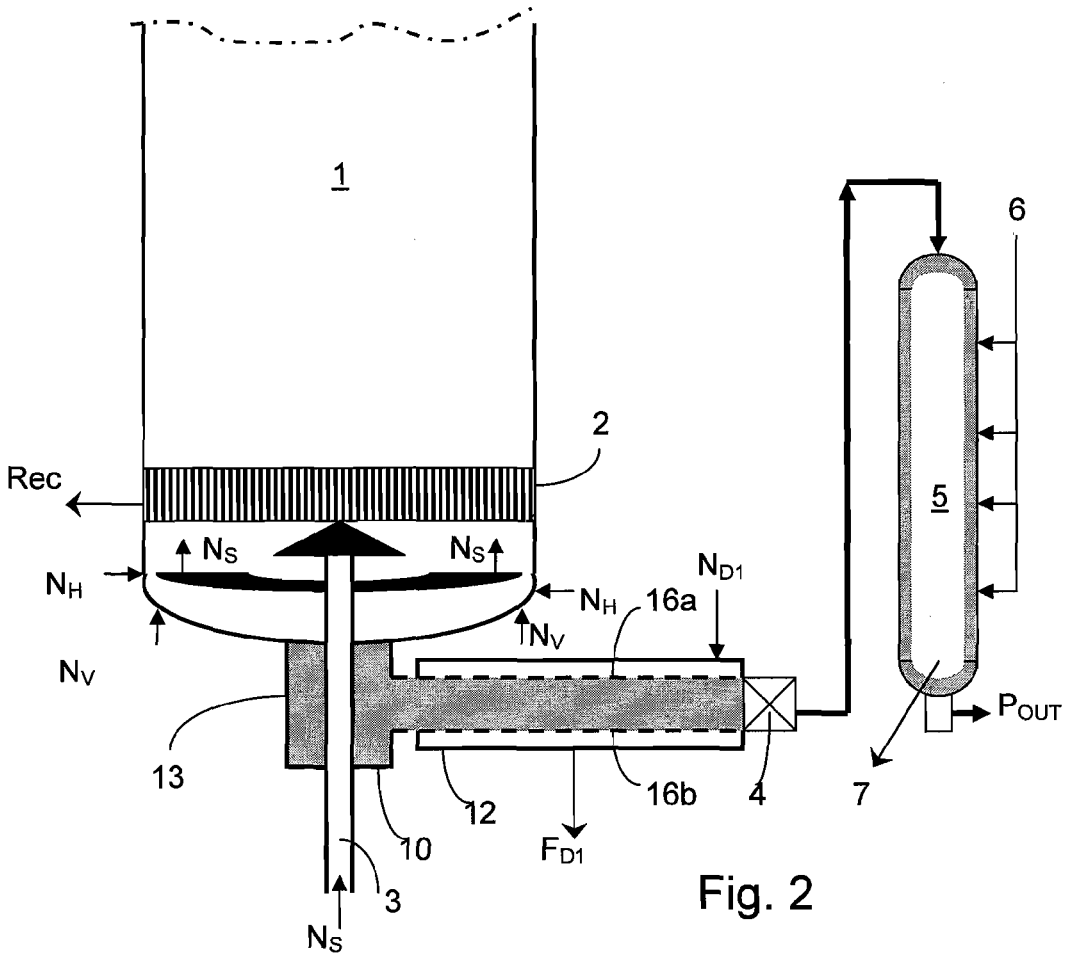
FIG. 2 shows a first embodiment of the invention.
Figure 5:
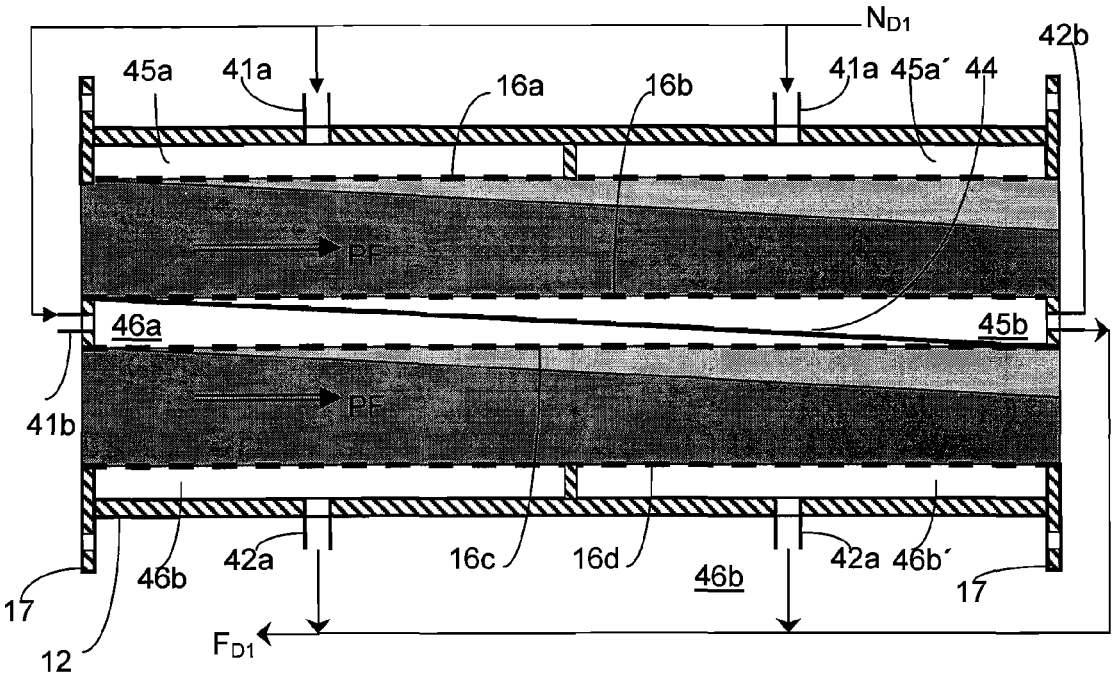
FIG. 5 shows a more detailed displacement wash in a module of the outlet line.

A first embodiment of the invention is shown in FIG. 2, where one part is shown in a larger format in FIG. 5. The arrangement is located in the outlet line 12, connected to the outlet tap 10 and before a blow-valve 4. The digested softened chips are fed out under the influence of a bottom scraper driven by a shaft 3 arranged at the bottom of the digester and subsequently through an bucket shaped outlet tap 10 at the bottom of the digester, and onwards to an outlet line 12 connected to the outlet tap before the softened chips pass through a blow-valve 4 arranged in the outlet line. The defibrated pulp is fed after the blow-valve to washing equipment, shown here as a conventional pressure diffuser 5, where washing fluid 6 is led into the bed of pulp from outside and a filtrate 7 is withdrawn from the centre of the pressure diffuser.

A pressure drop of at least 0.5 bar and at most 3-5 bar is established across the blow-valve.

The outlet line 12 is here designed as a displacement wash in a module of the outlet line before the blow-valve 4. An axially running first wall section 16*a* is shown in the drawing with nozzles for the addition of washing fluid $N_{D1}$ and at least one axially running second section of wall 16*b* with strainer surfaces for the withdrawal of expelled cooking fluid $F_{D1}$, where these sections of wall are located on diametrically opposing side of each other in the inner surface of the outlet line.

Figure 3A:
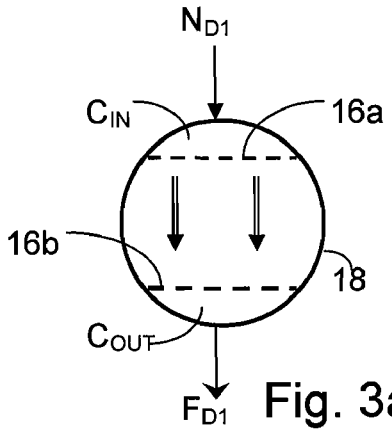
FIG. 3 shows three different embodiments of the outlet line according to the invention.

A section of the module is shown in FIG. 3*a* in which a tubular pressure vessel 18 surrounds the complete arrangement with a first wall section 16*a* that runs axially and a second wall section 16*b* that runs axially and with strainer surfaces. The washing fluid $N_{D1}$ is added to a chamber $C_{IN}$ between the pressure vessel 18 and the first section of wall 16*a*. Expelled cooking fluid $F_{D1}$ is then withdrawn through the second section of wall 16*b* that has strainer surfaces to a chamber $C_{OUT}$.

Figure 3B:
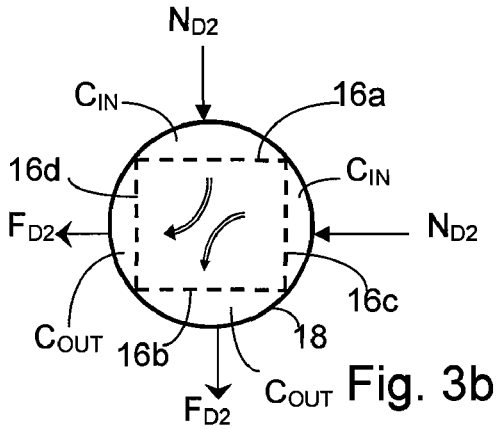
Figure 3C:
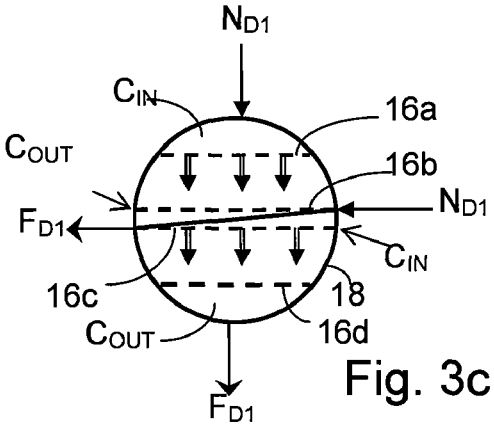

The flow of washing fluid, the displacement flow, and the filtrate are shown in FIGS. 3*a* to 3*c* using different arrows: WL, DW, and F, respectively.

A section of an alternative second embodiment of the module is shown in FIG. 3*b* in which a tubular pressure vessel 18 surrounds the complete arrangement with a first wall section 16*a* that runs axially, a second wall section 16*b* that runs axially and with strainer surfaces, a third wall section 16*c* that runs axially, and a fourth section of wall 16*d* that runs axially and with strainer surfaces. The washing liquid $N_{D1}$ is added in this embodiment to two chambers $C_{IN}$ between the pressure vessel 18 and the first section of wall 16*a* and between the pressure vessel 18 and the third section of wall 16*c*. Expelled cooking fluid $F_{D1}$ is then withdrawn through the second section of wall 16*b* with strainer surfaces and through the fourth section of wall 16*d* with strainer surfaces to two separate outlet chambers $C_{OUT}$. In this case a first displacement flow DW is formed that passes from a location at a position at 3 o'clock to a position at 6 o'clock, together with a second displacement flow DW that passes from a location at a position at 12 o'clock to a position at 9 o'clock.

A section of an alternative third embodiment of the module is shown in FIG. 3*c* in which a tubular pressure vessel 18 surrounds the complete arrangement with a first wall section 16*a* that runs axially, a second wall section 16*b* that runs axially and with strainer surfaces, a third wall section 16*c* that runs axially, and a fourth section of wall 16*d* that runs axially and with strainer surfaces, and where all sections of wall are parallel and form between them two channels for the softened chips. Washing liquid $N_{D1}$ is added in this embodiment to a first chamber $C_{IN}$ between the pressure vessel 18 and the first section of wall 16*a* and it is added to a second chamber $C_{IN}$ between an oblique separator wall and the third section of wall 16*c*. Expelled cooking fluid $F_{D1}$ is then withdrawn through the second section of wall 16*b* with strainer surfaces and through the fourth section of wall 16*d* with strainer surfaces to two separate outlet chambers $C_{OUT}$. In this case, first and second displacement flows DW are formed through two separate flows of the softened chips.

It is appropriate that the module in the outlet line have a length of between 2 and 6 meters. Since full cooking pressure has been established in the pulp at this position, the module must be designed as a pressure vessel, and it is for this reason appropriate that the module be constituted by a tubular pressure vessel, in which pressure vessel the wall sections for the addition and withdrawal of washing fluid are arranged as exchangeable plates.

Figure 4:
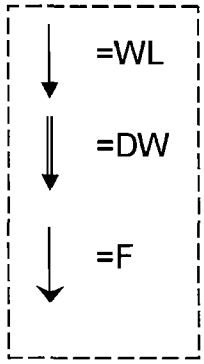
FIG. 4 shows how a number of modules of the outlet line according to the invention can be coupled together.
Figure 4:
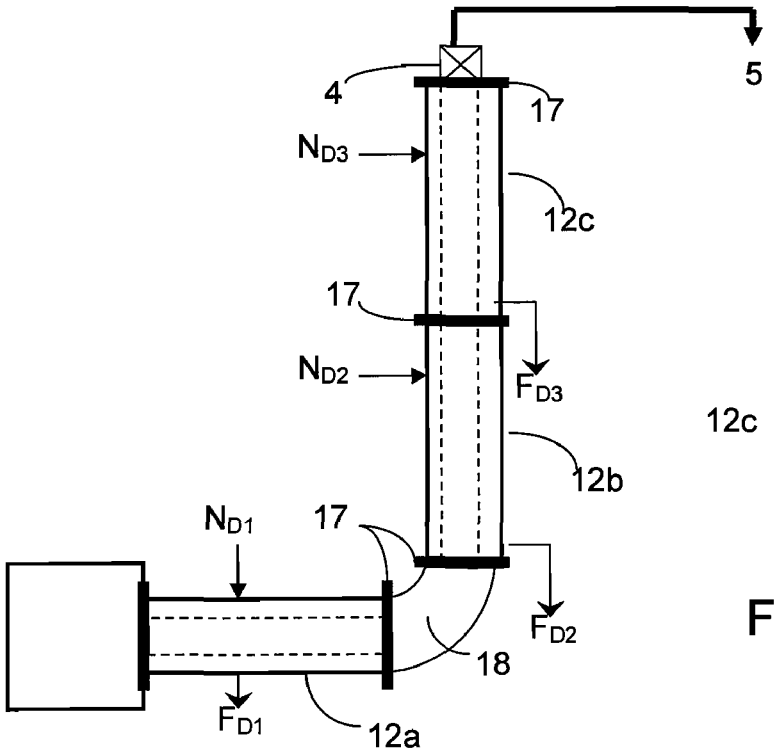

By designing the arrangement as a module, increased displacement washing can be easily installed by arranging at least two modules of the outlet line in series, as is shown in FIG. 4. In the case of this installation, at least one module 12*a* of the outlet line can be arranged in a horizontally running part of the outlet line and at least one module 12*b*/12*c* of the outlet line can be arranged in a vertically running part of the outlet line.

A more detailed module that corresponds to the embodiment shown in FIG. 3*c* is shown in FIG. 5. The module is a tubular pressure vessel 18 with flanges 17 that surround the complete arrangement. The first section of wall 16*a* that runs axially has two parallel inlet chambers 45*a*/45*a*' externally to the module in order to achieve a better distribution of washing fluid along the length of the module. Several inlet chambers can, of course, be implemented. A second section of wall 16*b* that runs axially and with strainer surfaces is arranged at a distance that is less than half of the diameter of the module. Expelled cooking fluid $F_{D1}$ is subsequently withdrawn through the second section of wall 16*b* that has strainer surfaces to an outlet chamber 45*b*/$C_{OUT}$, and the expelled cooking fluid is withdrawn from the outlet chamber from this chamber through the outlet 42*b*. The bottom of the outlet chamber 45*b*/$C_{OUT}$ is constituted by an oblique separator wall 44. A first sub-flow of softened chips PF is formed between the first and the second sections of wall.

A second inlet chamber 46*a* is formed between the oblique separator wall 44 and a third section of wall 16*c* that runs axially for the distribution of washing fluid along the length of the module, which washing fluid is input through the inlet 41*b*. A fourth section of wall 16*d* that runs axially and that has strainer surfaces is arranged at a distance. Expelled cooking fluid $F_{D1}$ is subsequently withdrawn through the fourth section of wall 16*d* that has strainer surfaces to two outlet chambers 46*b*/46*b*' ($C_{OUT}$), and the expelled cooking fluid is withdrawn from this chamber from the outlet chamber through the outlet 42*a*/42*a*'. The bottom of the outlet chamber 46*b*/46*b*' ($C_{OUT}$) is constituted by the inner surface of the pressure vessel. A second sub-flow of softened chips PF is formed between the third and the fourth sections of wall.

Figure 6A:
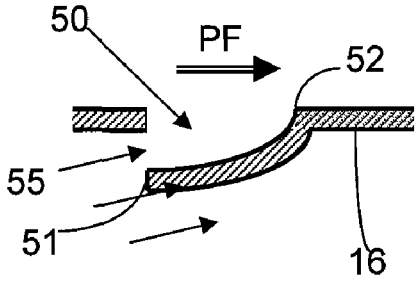
FIGS. 6*a*-6*b* show a detail of the design of the wall section with its nozzles in a first embodiment.
Figure 6B:
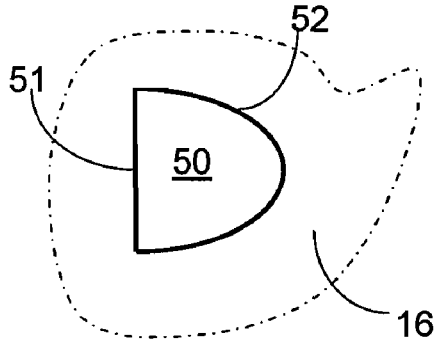

An appropriate first embodiment is shown in FIG. 6*a*, seen from above in FIG. 6*b*, of the nozzles that are formed in the various sections of wall 16*a*-16*d*. The wall or the strainer surface 16 has been designed with a depression that has a form that corresponds to the edge of a cheese grater. The flow of softened chips formed is here shown by the arrow PF, and it passes first over the straight edge 51 of the perforation and passes over the depression 50 before the flow reaches the rounded edge 52 of the depression, which edge lies downstream. Since the flow is constituted by softened chips that retain a tendency to bind together, an appropriate depression can be given a form in which the edge 51 is not much longer, preferably shorter, than the minor axis of the chips, which normally passes transverse to the direction of the fibre. (Chips are normally cut with a certain thickness and with a minor axis that runs transverse to the direction of the fibre, and with a major axis that lies parallel to the direction of the fibre.)

Figure 6C:
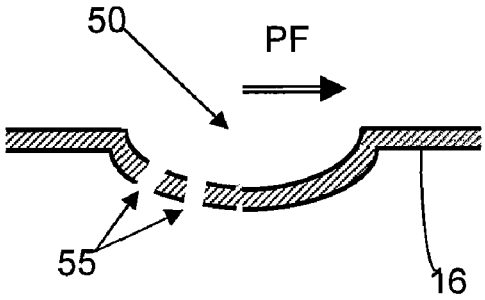
FIGS. 6*c*-6*d* show a detail of the design of the wall section with its nozzles in a second embodiment.
Figure 6D:
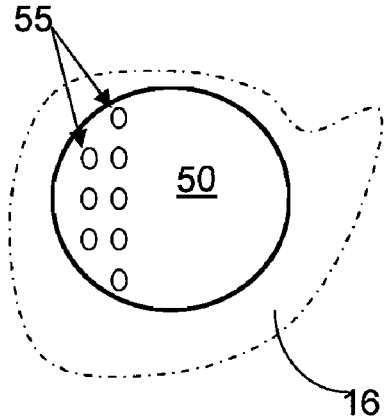

An appropriate second embodiment is shown in FIG. 6*c*, seen from above in FIG. 6*d*, of the nozzles that are formed in the various sections of wall 16*a*-16*d*. The wall or strainer surface 16 has been designed with a round depression with a form that corresponds to the dimples on a golf ball. The flow of softened chips formed is here shown by the arrow PF. Holes 55 are located in one or several rows at the half of the depression that lies upstream. Since the flow is constituted by softened chips that retain a tendency to bind together, it is appropriate that the round depression be given a diameter that is not much longer, preferably shorter, than the minor axis of the chips, which normally passes transverse to the direction of the fibre. (Chips are normally cut with a certain thickness and with a minor axis that runs transverse to the direction of the fibre, and with a major axis that lies parallel to the direction of the fibre.)

The method and the arrangement according to the invention can be modified in several ways within the framework of the patent claims. In those cases in which several modules have been placed in series, a similar displacement effect can be established in all modules, which means that the direction of displacement is the same in all flows of pulp, and when it is desired to change the direction of displacement in order to rinse clean the section of wall that has withdrawal function it is possible to synchronise in steps the change in the modules with the rate of flow of the pulp.

In the case in which several modules are used, the washing fluid can be led in series through these modules. In the embodiment shown in FIG. 4, the filtrate $F_{D3}$ from the last module 12*c* can be led in as washing fluid $N_{D2}$ into the second module, and finally the filtrate $F_{D2}$ from the second module 12*b* can be led into the first module as washing fluid $N_{D1}$. Such a serial wash using counterflow can also take place in several steps in an individual module similar to that shown in FIG. 5, with several chambers 45*a*, 45*a*', 46*b*, 46*b*' and a corresponding chamber division into 45*b* and 46*a*.

Example of Implementation

For a continuous digester with a capacity of over 4,000 tonnes (ADT) pulp per day, the diameter of the bottom of the digester is 12.5 m. The outlet tap for this magnitude of digester typically has a diameter of 2.1 m and a height of 1.1 m.

The outlet line typically has a diameter of 0.5 m.

The internal surface area of the outlet line for each stretch of length 2 m will then be approximately 3.14 $m^2$.

With a typical strainer loading, i.e. the withdrawal capacity of the strainer surface, of 5-10 $m^3$/hour/$m^2$, it is then possible in a digester of this magnitude to establish a withdrawal volume of 36-72 $m^3$/hour from the outlet tap and 15-31 $m^3$/hour from a module of length 2 m of the outlet line.

With a length of four modules of the outlet line arranged in series before the blow-valve, it would be possible to increase the dilution factor by up to 0.3 (i.e. 0.3 $m^3$ per ADT of pulp), given a production of 4,000 tonnes of pulp per day.

While the present invention has been described in accordance with preferred compositions and embodiments, it is to be understood that certain substitutions and alterations may be made thereto without departing from the spirit and scope of the following claims.

The invention claimed is:

1. A method for the improvement of a wash after a completed digestion process in a continuous digester for a production of cellulose pulp, comprising:

digested softened chips passing a final strainer section at a bottom of the digester, feeding out the digested softened chips under an influence of a bottom scraper arranged at the bottom of the digester;

passing the digested softened chips through a bucket-shaped outlet tap at the bottom of the digester and onwards to an outlet line connected to the outlet tap;

establishing a pressure drop across a blow-valve, arranged in the outlet line, of at least 0.5 bar and at most 3 bars, the pressure drop defibrating the digested softened chips, establishing a displacement wash in a flow of the digested softened chips through the outlet line, subjecting the digested softened chips to the displacement wash after the digested softened chips having passed through the outlet tap, and the digested softened chips passing through the blow-valve.

2. The method according to claim 1 wherein the displacement wash is established between two opposing walls of the outlet line, wherein one wall has nozzles for an addition of a washing fluid and a second opposing wall has strainer surfaces for a withdrawal of liquid.

3. The method according to claim 1 wherein a displacement wash through the addition and withdrawal in the two opposing walls exchanges between 0.1 and 2 $m^3$ of liquid per tonne of pulp (ADT) for each 2 meters of the outlet line.

4. The method according to claim 3, wherein the displacement wash changes a direction of displacement after a predetermined time, a first wall section having nozzles defined therein for adding the washing fluid during a first period of time and then in a subsequent second period of time withdrawing liquid, with an inverse functionality taking place in a second wall section.

5. An arrangement for an improvement of a wash after a completion of digestion in a continuous digester for a production of cellulose pulp, comprising:

a digester having a final strainer disposed at a bottom of the digester, a bottom scraper arranged at the bottom of the digester for feeding out digested softened chips, a bucket-shaped outlet tap disposed below the digester and in fluid communication with the bottom of the digester for receiving the digested softened chips from the digester, an outlet line in fluid communication with and downstream of the bucket-shaped outlet tap, a blow-valve, in operative engagement with and downstream of the outlet line, for establishing a pressure drop across the blow valve of at least 0.5 bar and at most 3 bars, a module disposed in the outlet line, the module having a first axial wall section, the first axial wall section having nozzles defined therein for adding a washing fluid into the outlet line, the module having a second axial wall section, the second axial wall section having strainer surfaces for withdrawing expelled cooking fluid from the outlet line, and the first axial wall section being diametrically opposite the second axial wall section in an inner surface of the outlet line.

6. The arrangement according to claim 5 wherein the module has a length of between 2 and 6 meters.

7. The arrangement according to claim 6 wherein the module is constituted by a tubular pressure vessel having third and a fourth wall sections in addition to the first and second axial wall sections.

8. The arrangement according to claim 5, wherein the module has a third axial wall section, the third axial wall section has nozzles for adding-the washing fluid, and the module has a fourth axial wall section that has strainer surfaces for withdrawing the expelled cooking fluid, and the nozzles facing the strainer surfaces.

9. The arrangement according to claim 5 wherein the arrangement has a second module arranged in series with the module in the outlet line.

10. The arrangement according to claim 9, wherein the module is disposed in a horizontal part of the outlet line and the second module is disposed in a vertical part of the outlet line.

* * * * *